US010495411B1

(12) United States Patent
Tedder et al.

(10) Patent No.: US 10,495,411 B1
(45) Date of Patent: Dec. 3, 2019

(54) HOLSTER MOUNT ASSEMBLY

(71) Applicant: Tedder Industries, LLC, Post Falls, ID (US)

(72) Inventors: Thomas Tedder, Post Falls, ID (US); Taylor Vold, Valleyford, WA (US)

( * ) Notice: Subject to any disclaimer, the term of this patent is extended or adjusted under 35 U.S.C. 154(b) by 0 days.

(21) Appl. No.: 16/058,751

(22) Filed: Aug. 8, 2018

(51) Int. Cl.
*F41C 33/04* (2006.01)

(52) U.S. Cl.
CPC ..... *F41C 33/045* (2013.01)

(58) Field of Classification Search
CPC ..... F41C 33/041; F16M 13/00; F16M 13/04; F16M 13/02; F16M 11/10
USPC ..... 248/689, 222.52, 229.17
See application file for complete search history.

(56) References Cited

U.S. PATENT DOCUMENTS

2010/0200715 A1* 8/2010 Kuipers ..... B62J 6/02 248/221.11
2014/0252188 A1* 9/2014 Webster ..... F16M 13/022 248/229.17
2015/0233669 A1* 8/2015 Ponder ..... F41C 33/001 224/271
2015/0377585 A1* 12/2015 Fowler ..... F41C 33/0236 224/271
2018/0195834 A1* 7/2018 Tedder ..... A45F 5/02

* cited by examiner

*Primary Examiner* — Corey N Skurdal
(74) *Attorney, Agent, or Firm* — Timberline Patent Law Group

(57) ABSTRACT

Representative implementations of devices and techniques provide a holster mount assembly, to mount and to support an implement or an implement holster, or the like, in a variety of configurations on a personal or tactical accessory. The holster mount assembly includes at least a base, a grip plate, and a latch plate. The latch plate is arranged to engage the grip plate to compress the base and the grip plate onto a portion of the personal or tactical accessory.

21 Claims, 8 Drawing Sheets

HOLSTER MOUNT ASSEMBLY

CROSS-REFERENCE TO OTHER APPLICATIONS

This disclosure is related to United States Patent Application Publication No. US 2018/0195834 A1, filed Jan. 11, 2018, and United States Patent Application Publication No. US 2018/0202764 A1, filed Jan. 18, 2018, both of which are incorporated herein in their entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

Holster mounting accessories are often used to mount a holster to an article of clothing for wear by the user. A holster mounting accessory should reliably retain the holster, supporting the weight of the holster and the implement within. The mounting accessory should allow the user to draw the handgun for use without undue effort or difficulty, and to replace the handgun in the holster easily. The mounting accessory should retain the holster during the drawing and reholstering, and any other activity that may put a strain on the holster, mounting accessory, or the user's clothing. Mounting accessories may also be used to mount a holster to a user's wearable item, such as a backpack, or the like, with similar durability, usability, and other advantages.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Representative implementations of devices and techniques provide a holster mount assembly, to mount and to support an implement (such as a handgun, for example) or an implement holster (such as a handgun holster or shell, for example), or the like, in a variety of configurations. The holster mount assembly is arranged to be worn on a user's person, clothing, or gear (backpacks, gear packs, range bags, duffle bags, accessories, straps, belts, etc.), for example, for temporarily and safely carrying the implement, while making the implement easily accessible to the user.

In various examples, the holster mount assembly can be mounted to the user's personal gear for carrying the implement externally or in a concealed manner. For example, the holster mount assembly can be fitted around a strap of a personal accessory, such as a backpack, range bag, tactical wear, hunting gear, or the like, locking in position onto the strap and providing an accessible mount for the implement or implement holster. The holster mount assembly ("mount assembly") can also be worn on other parts of a user's person, or can be used to support an implement or implement holster in another location, that is not on a user.

In various embodiments, the mount assembly comprises a two piece or three (or more) piece strap mount assembly. The components of the mount assembly are sandwiched over a strap (or the like) to firmly secure the mount assembly to the strap (i.e., compress the strap between plates of the mount assembly). A holster or other item can be temporarily or permanently coupled to one or more of the mount assembly components. The mount assembly can be moved by releasing the tension (loosening the coupling fasteners or straps) between the components, sliding the mount assembly to a new location, and tightening the fasteners to press the components together.

Techniques and devices are discussed with reference to example handgun holsters. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the mount assembly components illustrated in the figures may vary to accommodate various applications. In alternate embodiments, fewer, additional, or alternate components may be used and/or combined to form a mount assembly having an equivalent function and operation.

Implementations are explained in more detail below using a plurality of examples. Although various implementations and examples are discussed here and below, further implementations and examples may be possible by combining the features and elements of individual implementations and examples.

Example Embodiments

Figure 1:
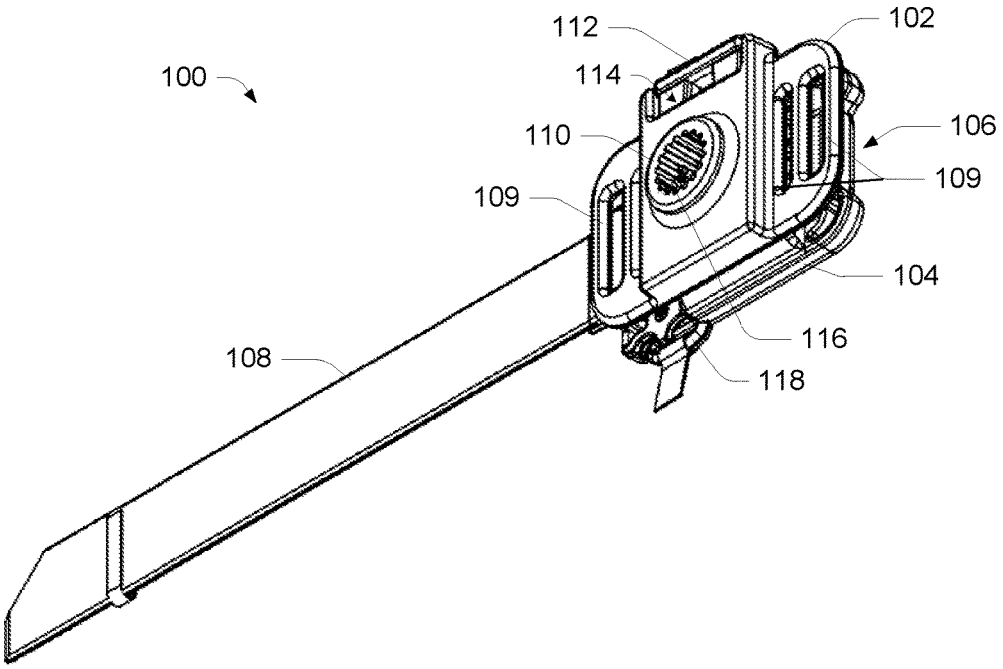
FIG. 1 shows a perspective view of an example holster mount assembly, according to an embodiment.
Figure 2:
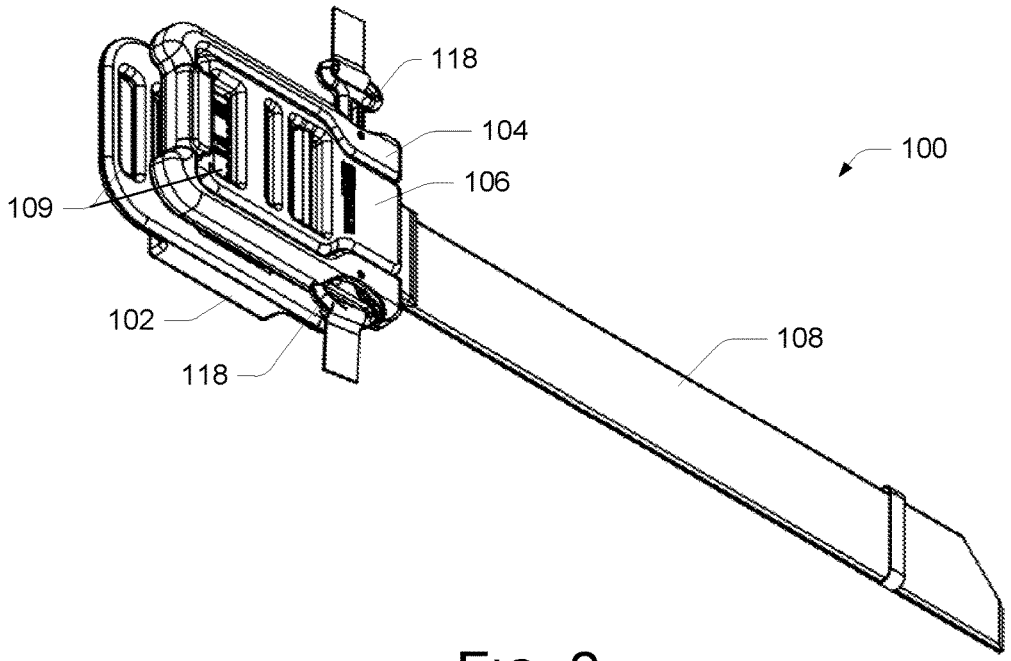
FIG. 2 illustrates another perspective view of the example holster mount assembly of FIG. 1, according to an implementation.
Figure 3:
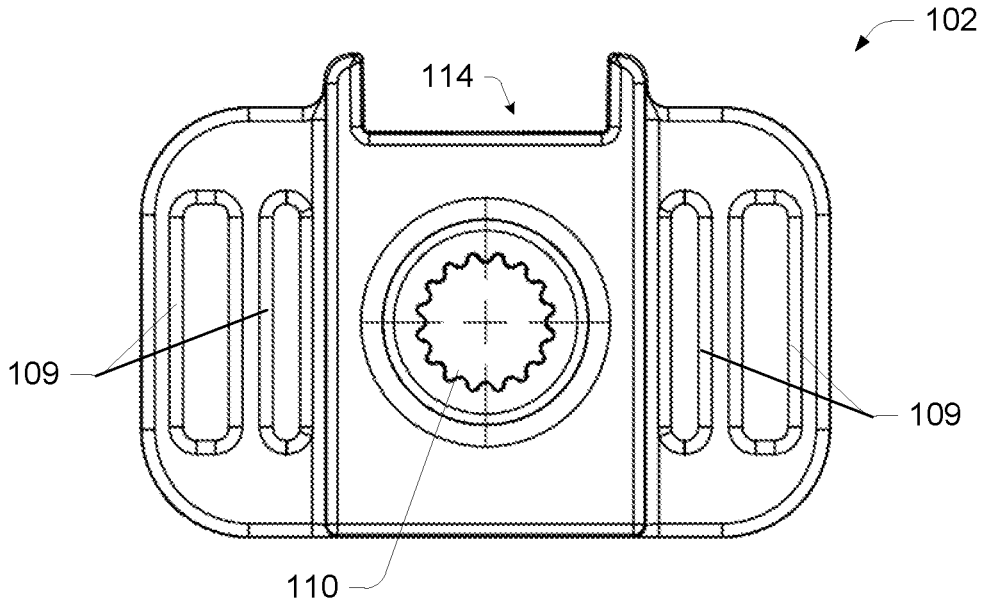
FIGS. 3 and 4 illustrate two views (front and back) of an example base of the holster mount assembly of FIG. 1, according to an implementation.

An example mount assembly 100 is shown in FIGS. 1 and 2. In various implementations, a mount assembly 100 may be removably coupled to a personal or tactical accessory such as a backpack, range bag, hunting gear, or the like, for mounting a carrier (such as a handgun holster, for instance) to the personal accessory in a variety of configurations, including as worn on a person. In some implementations, multiple mount assemblies 100 can be coupled to one or more personal or tactical accessories, so that multiple carriers (holsters, cases, magazine carriers, and so forth) may be carried by the user in a variety of configurations.

In an embodiment, as shown in FIGS. 1 and 2, a mount assembly 100 includes a base 102 and a grip plate 104. In some embodiments, the mount assembly also includes a latch plate 106. In various implementations, the mount assembly 100 may include additional components. For example, the mount assembly 100 may also include a strap 108. In an embodiment, the strap 108 couples the base 102 and the grip plate 104 together, as well as the latch plate 106, when included. In a further embodiment, the strap 108 couples the base 102, grip plate 104, and latch plate 106 to the tactical accessory, or the like. In an alternate embodiment, a portion of the strap 108 may be wrapped around a strap or other portion of the tactical accessory along with the base 102, grip plate 104, and latch plate 106.

Referring to FIGS. 1-4, in various embodiments, the base 102 comprises a substantially planar hard mount component. The base 102 includes a plurality of slots 109 through a portion of the base 102 that may be used to thread the strap 108 through the base 102. Threading the strap 108 through the slots 109 can be used to couple the base 102 to the grip plate 104 and the latch plate 106, when included (see FIG. 14) and to couple the mount assembly 100 to a desired object, such as the tactical accessory (see FIG. 17). In various embodiments, each of the base 102, the grip plate 104, and the latch plate 106 include one or more slots 109 for threading the strap 108 through, to couple the components together and to couple the components to the desired object. In alternate embodiments, the base 102, the grip plate 104, and the latch plate 106 (when included) may be coupled together using one or more of other types of components (e.g., hinges, fasteners, clamps, rings, cables, etc.) or combinations thereof, including combinations having one or more straps 108.

Figure 4:
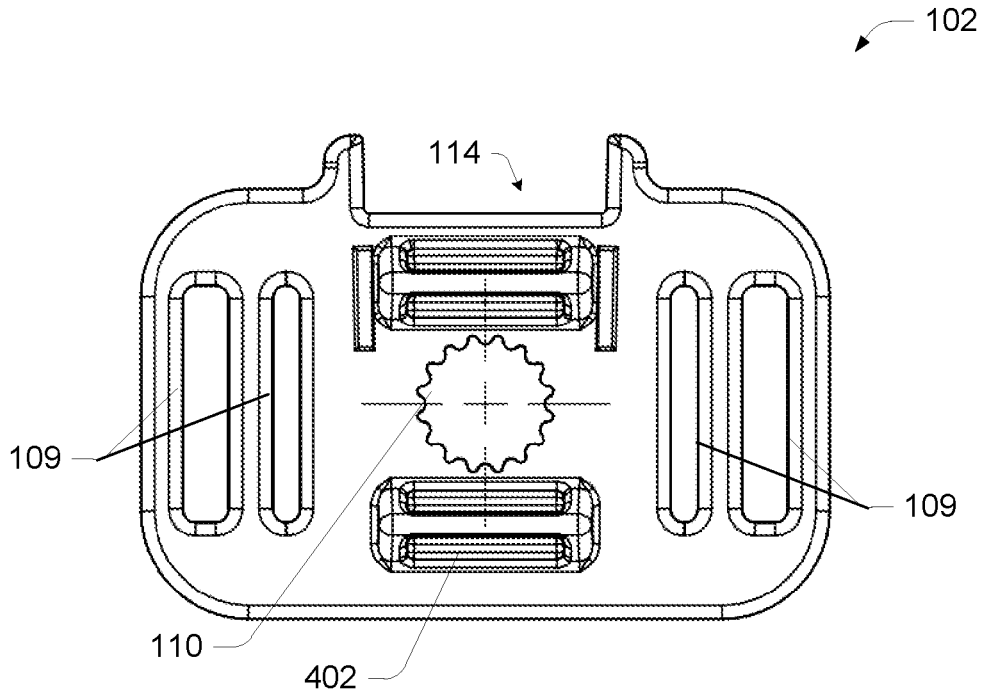

Referring to FIG. 4, in various implementations, the base 102 includes one or more grip features 402. For example, the grip features 402 can be disposed on the back side of the base 102, or on the side of the base 102 intended to be facing the desired object (e.g., the strap of a backpack, range bag, tactical accessory, etc.) when the mount assembly 100 is coupled to the desired object. The grip features 402 are intended to help the base 102 to grip the desired object securely, preventing the movement of the base 102 with respect to the desired object.

In an embodiment, the grip features 402 comprise one or more textured features that are integral to (i.e., molded into the base 102, etc.) or coupled to the base 102 (using fasteners, adhesives, or the like). The grip features 402 may be comprised of the same material or a different material as the base 102. In the embodiment, the one or more grip features 402 increase the friction of a portion or a surface of the base 102, due to the physical features, including the shape and/or the orientation of the grip features 402. For example, the grip features 402 may include one or more protrusions, or the like, extending from and arranged on the surface of the base 102. In another example, the grip features 402 may include patterns, textures, and the like, molded into the surface of the base 102 or applied to the surface of the base 102. In an implementation, grip features 402 on a portion of a surface of the base 102 changes (i.e., increases) a coefficient of friction of the surface of the base 102, based on the physical characteristics of the grip features 402.

In various implementations, protrusions or textures of the grip features 402 may have various shapes (e.g., pointed, rounded, blunted, rectangular, etc.), sizes, layout, arrangement, spacing, and quantities, and may be oriented at various angles with respect to the surface of the base 102 to achieve desired friction results. In other words, orienting includes that the grip features 402 may also extend from the surface of the base 102 at an angle, rather than only perpendicular to the surface of the base 102.

Referring to FIGS. 1-7, in an embodiment, the base 102 includes a locking receiver 110, arranged to support an implement or an implement holster, such as the splined locking receiver 110 described in United States Patent Application Publication No. US 2018/0195834 A1, which is incorporated herein in its entirety. In various examples, the receiver 110 comprises an adapter arranged to receive a portion of the implement, implement holster, or other carrier, to be mounted to the mount assembly 100. For instance, the carrier may include a male post portion (not shown) that is inserted into the receiver 110 of the base 102 to mount the carrier to the mount assembly 100 in one of multiple user-selected rotational orientations. The receiver 110 and the post may have matching size, shape, features, and so forth, so that the receiver 110 will receive the post in a secure manner.

In various implementations, a carrier is coupled to the base 102 by inserting a post of the carrier into the receiver 110 of the base 102. A preselected quantity of input splines (not shown) arranged around an outer perimeter of the post match up to the same preselected quantity and complementary shape of receiving splines 116 arranged around an inner perimeter of the opening of the receiver 110 for a secure fit. The input splines mesh with the receiving splines 116 as the post is inserted into the receiver 110.

In an alternate implementation, the quantity of input splines may be less than the quantity of receiving splines 116, but each of the input splines still meshes with a receiving spline 116 to secure the carrier to the receiver 110. In various implementations, the shape and profile of the input splines and the receiving splines 116 may vary (e.g., rounded, curved, sharp, polygonal, keyway shaped, irregularly shaped, shallow, moderately deep, deep, etc.), with the input splines arranged to mesh with the receiving splines 116 to removably couple the post to the base 102.

The spline attachment nature of the receiver 110 allows a user to position the implement or holster (e.g., carrier) at various angles between 0 and 360 degrees, by positioning the post of the carrier into the receiver 110 at the desired rotational angle (i.e., cant) with respect to the base 102. For example, depending on the quantity of input splines and receiving splines 116, a number of discrete angular positions (e.g., discrete rotational angular increments) are possible between the post and the base 102. In one embodiment, for example, the input splines and receiving splines 116 allow for various angles in 22.5 degree increments. In other embodiments having other numbers of splines 116, other angles or increments are possible. A user can adjust the rotational orientation of the post with respect to the base 102 (e.g., adjust the cant of the carrier attached to the post) at any time by unlocking the post, removing the post from the receiver 110, and reinserting the post into the receiver 110 at a new desired angle.

Figure 5:
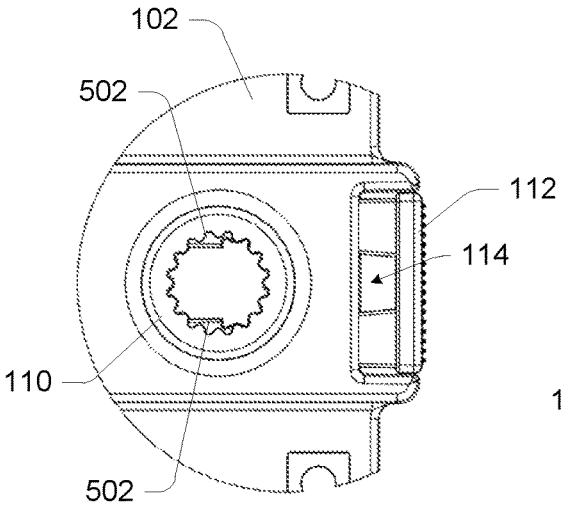
FIGS. 5 and 6 illustrate two views (locked and unlocked) showing detail of an example locking arrangement of a base, according to an implementation.
Figure 6:
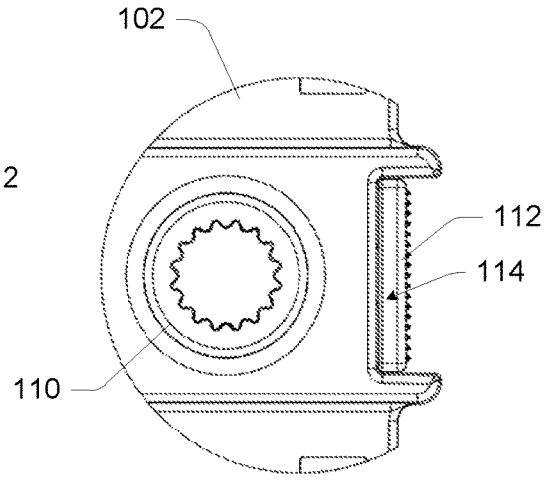
Figure 7:
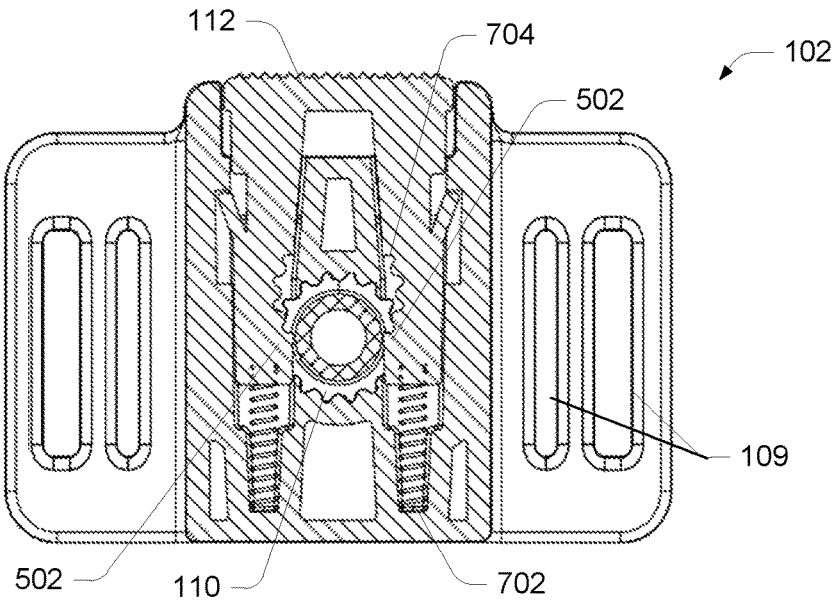
FIG. 7 shows a cut-away view of an example locking arrangement of a base, in a locked configuration, according to an implementation.

Referring to FIGS. 5-7, as the post (not shown) is inserted into the receiver 110, one or more lock features 502 (such as a catch, for example) of the base 102 locks onto the post, holding the post within the receiver 110, until it is intentionally released. For instance, the post may include a groove, or one or more other features, that engages the lock features 502. The lock features 502 of the base 102 hold the post securely in place within the receiver 110, regardless of the orientation of the post with respect to the base 102. The post may be released from the base 102 by activating a lock release button 112, for example. When the lock release button 112 is activated, the lock features 502 release the post from the base 102. The post may then be pulled away from the receiver 110.

In an embodiment, the lock release button 112, which may be inserted into a cavity 114 within the base 102 is allowed to slide in and out (relative to the base 102) within the cavity 114. In the locked position, as shown in FIGS. 5 and 7, the lock release button 112 is in an extended position (e.g., the button 112 is extended out of the cavity 114). In the unlocked position, as shown in FIG. 6, the lock release button 112 is in a retracted position (e.g., the button 112 is pushed into the cavity 114).

In various embodiments, the button 112 is spring-loaded, and is at rest in the extended position and is in tension in the retracted position. In other words, the button 112 will return to the extended position when it is released after being moved into the retracted position. In alternate embodiments the button is at rest in the retracted position, or may not be biased (e.g., the button 112 may function like a switch). In various embodiments, this locking method can work with other types of passive and active shaft 108 retention methods (e.g., a thumb push button, activation lever, etc.) allowing for versatility in operation and application.

FIGS. 5 and 7 show detail views of the receiver 110 in a locked configuration (i.e., the locking mechanism in the locked configuration) and FIG. 6 shows a detail view of the receiver 110 in an unlocked configuration (i.e., the locking mechanism in the unlocked configuration). As shown in FIG. 5, when the base 102 (i.e., the locking mechanism) is in the locked configuration (the button 112 is extended), the one or more lock features 502 protrude into the opening of the receiver 110. As shown in FIG. 6, when the base 102 (i.e., the locking mechanism) is in the unlocked configuration (the button 112 is retracted into the base 102), the one or more lock features 502 are clear from the opening of the receiver 110. In various embodiments, the post may be inserted into the receiver 110 with the base 102 in either the locked or the unlocked configuration.

For example, FIG. 7 shows a cut-away view of the base 102, according to an embodiment. FIG. 7 shows a non-limiting example of the action of an example locking arrangement of a base 102. In alternate implementations, other action techniques and/or other components may be employed to perform the functions disclosed.

As shown in FIG. 7, in the embodiment, the locking features 502 are integral to or coupled to the button 112, which may be spring-loaded or otherwise biased (using one or more springs 702, for example). The locking features 502 move out of the way when the post is inserted into the receiver 110 while the locking mechanism is in a locked configuration, and move back into place (protruding into the receiver 110 opening) when encountering the groove of the post. The reduced diameter of the post at the groove can allow the button 112 to return to the rest position (e.g., the extended position), closing on the groove, which automatically traps the post in the receiver 110.

In an embodiment, as shown in FIG. 7, the button 112 includes splined features 704, which are arranged to line up with the receiving splines 116 when the locking features 502 are moved out of the way by the post, as the post enters the receiver 110, or when the locking features 502 are moved out of the way as the button 112 is retracted into the base 102. For example, depressing the button 112 aligns the splined features 704 to the receiving splines 116 so that the post can be removed from the receiver 110 (to remove or reposition the post, for example).

In alternate embodiments, the receiver 110 may include other components for attaching an implement or an implement holster to the base 102. For instance, the receiver 110 may comprise a component that includes one or more of various fasteners, slides, clips, or other attachment components for temporarily or permanently coupling the implement or an implement holster to the base 102. For example, a holster may be coupled to the base 102 with rivets, screws, T-nuts, or the like, or a holster may be coupled to the base 102 by sliding a portion of the holster onto a clip or keeper, or the like, on the base 102. In some implementations, the receiver 110 is a modular component that may be interchanged with other modular receivers 110 as desired by the user, and based on the attachment components of the implement or the implement holster.

Figure 8:
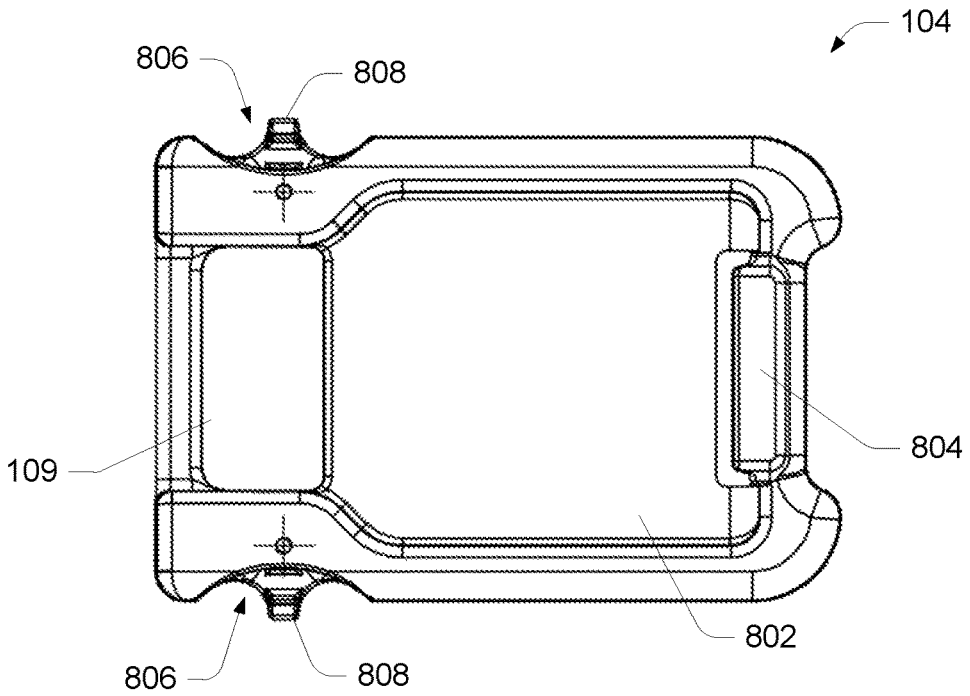
FIGS. 8 and 9 illustrate two views of an example grip plate of the holster mount assembly of FIG. 1, according to an implementation.
Figure 9:
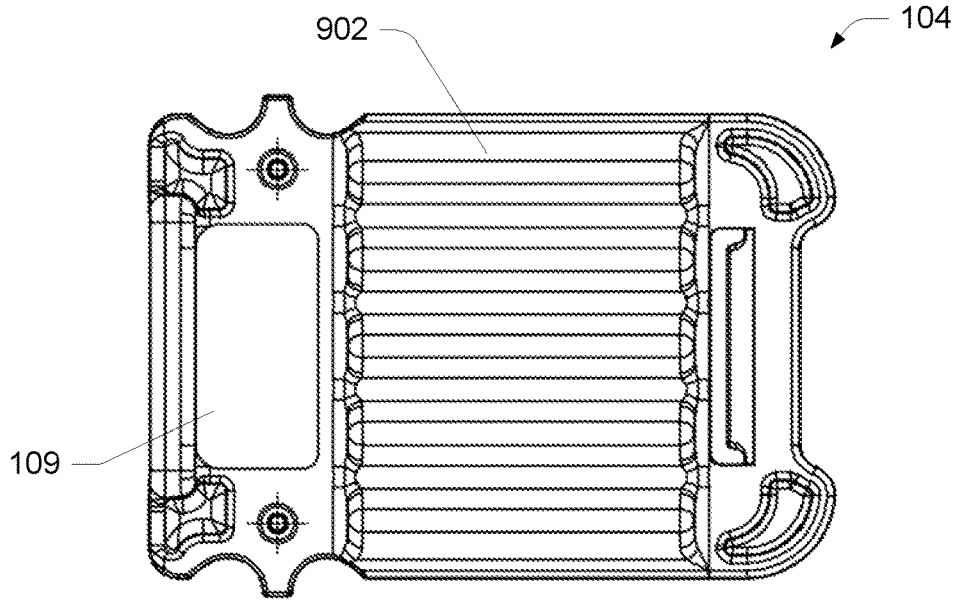

FIGS. 8 and 9 illustrate two views of an example grip plate 104 of the mount assembly 100, according to an implementation. FIG. 8 illustrates an example front side of the grip plate 104, and FIG. 9 illustrates an example back side of the grip plate 104. For instance, the back side of the grip plate 104 is the side that is facing the tactical accessory or other object the mount assembly 100 is mounted to.

As shown in FIGS. 8 and 9, the grip plate 104 includes one or more slots 109 through a portion of the grip plate 104, used to thread the strap 108 through, to couple the grip plate 104 to the base 102, and to the desired object. For instance, at least one side of the base 102 is coupled to the grip plate 104 via the strap 108 (see FIG. 14).

As shown in FIG. 8, the front side of the grip plate 104 can include a depression or recess 802. In some embodiments, the recess 802 is arranged to fit the shape of the latch plate 106, some portion of the latch plate 106, or a locking mechanism for the latch plate 106. In an embodiment, when the mount assembly 100 is locked onto the desired object, the latch plate 106 mates with the grip plate 104 at the recess 802. In some embodiments, the recess 802 may have the shape of a portion of the latch plate 106 or a protrusion on the latch plate 106, for example. In other embodiments, the recess 802 and the latch plate 106 have matching complementary shapes, and the latch plate 106 fits partially or fully within the recess 802.

As also shown in FIG. 8, the grip plate 104 may include a catch 804 arranged on a portion of the grip plate 104 to capture or engage a portion of the latch plate 106. For example, the catch 804 can be arranged to engage an edge of the latch plate 106, when locking the latch plate 106 to the grip plate 104. In various embodiments, the catch 804 may be integral to or coupled to the grip plate 104, protruding from a portion of the grip plate 104 and/or including a cavity, recess, or opening. In other words, the catch 804 is shaped to mate with a portion of the latch plate 106, conforming to the portion of the latch plate 106. In some embodiments, the catch 804 can act as a hinge, engaging a portion of the latch plate 106 and allowing the latch plate 106 to pivot at the catch 804 to lock the latch plate 106 to the grip plate 104, tensioning the strap 108, and thus locking the mount assembly 100 to the desired object.

As shown in FIG. 8, in some embodiments, the grip plate 104 includes one or more cavities, channels, or openings 806. In an embodiment, as shown in FIG. 8, the openings 806 originate on an edge of the grip plate 104. In other embodiments, the openings 806 may originate at other places on the grip plate 104. In the embodiments, an opening 806 is configured to receive a latch pin 118 (see FIGS. 12 and 13) or the like, to secure the latch plate 106 to the grip plate 104. For instance, the openings 806 may extend from an outside surface of the grip plate 104 to the interior of the recess 802, so that when the latch plate 106 is engaged with the recess 802, the latch pins 118 can extend through the openings 806 and into a portion of the latch plate 106. In this way, the latch plate 106 can be locked to the grip plate 104 until intentionally released. For example, to release the latch plate 106, the latch pin(s) 118 are removed from the openings 806, freeing the latch plate 106 to be removed from the grip plate 104.

In an implementation, as shown in FIG. 9, at least one surface of the grip plate 104 includes one or more grip features 902. For example, the grip features 902 can be disposed on the back side of the grip plate 104, or on the side of the grip plate 104 intended to be facing the desired object (e.g., the strap of a backpack, range bag, tactical accessory, etc.) when the mount assembly 100 is coupled to the desired object. The grip features 902 are intended to help the grip plate 104 to grip the desired object securely, preventing the movement of the grip plate 104 or the mount assembly 100 with respect to the desired object.

In an embodiment, the grip features 902 comprise one or more textured features that are integral to (i.e., molded into the grip plate 104, etc.) or coupled to the grip plate 104 (using fasteners, adhesives, or the like). The grip features 902 may be comprised of the same material or a different material as the grip plate 104. In the embodiment, the one or more grip features 902 increase the friction of a portion or a surface of the grip plate 104, due to the physical features, including the shape and/or the orientation of the grip features 902. For example, the grip features 902 may include one or more protrusions, or the like, extending from and arranged on the surface of the grip plate 104. In another example, the grip features 902 may include patterns, textures, and the like, molded into the surface of the grip plate 104 or applied to the surface of the grip plate 104. In an implementation, grip features 902 on a portion of a surface of the grip plate 104 changes (i.e., increases) a coefficient of friction of the surface of the grip plate 104, based on the physical characteristics of the grip features 902.

In various implementations, protrusions or textures of the grip features 902 may have various shapes (e.g., pointed, rounded, blunted, rectangular, etc.), sizes, layout, arrangement, spacing, and quantities, and may be oriented at various angles with respect to the surface of the grip plate 104 to achieve desired friction results. In other words, orienting includes that the grip features 902 may also extend from the surface of the grip plate 104 at an angle, rather than only perpendicular to the surface of the grip plate 104.

Figure 10:
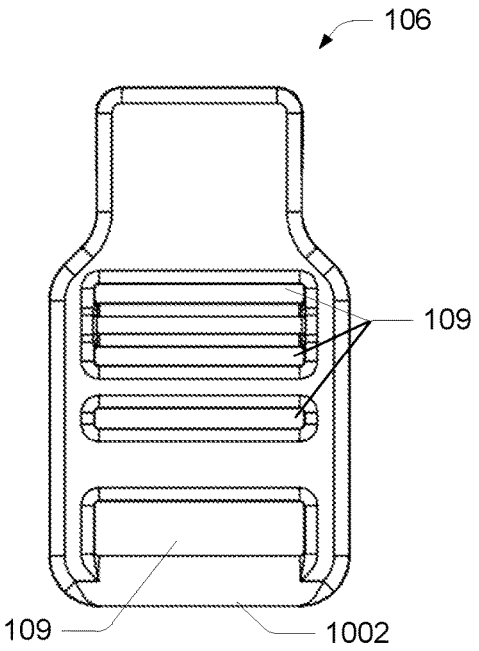
FIGS. 10 and 11 illustrate two views of an example latch plate of the holster mount assembly of FIG. 1, according to an implementation.
Figure 11:
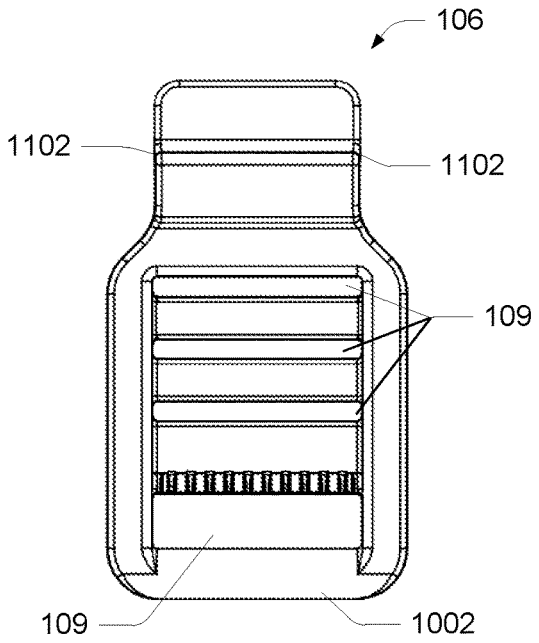

FIGS. 10 and 11 illustrate two views (front and back) of an example latch plate 106 of the mount assembly 100, according to an implementation. FIG. 10 illustrates an example front side of the latch plate 106, and FIG. 11 illustrates an example back side of the latch plate 106. For instance, the back side of the latch plate 106 is the side that is facing the grip plate 104 when the latch plate 106 is engaged to the grip plate 104. As shown in FIGS. 10 and 11, in an embodiment, the overall shape of the latch plate 106 may be the same as the shape of the recess 802 of the grip plate 104, so that the latch plate 106 can partially or fully fit within the recess 802. In alternate embodiments, a portion (such as a protrusion, for example) of the latch plate 106 is shaped accordingly and intended to fit within the recess 802. In various embodiments, the latch plate 106 may snap (or the like) into the recess 802 of the grip plate 104 when fully engaged with the grip plate 104.

As shown in FIGS. 10 and 11, the latch plate 106 includes one or more slots 109 through a portion of the latch plate 106, used to thread the strap 108 through, to couple the latch plate 106 to the base 102, and to the desired object. For instance, at least a second side of the base 102 is coupled to the latch plate 106 via the strap 108 (see FIG. 14). Additional slots 109 on the latch plate 106 may be used to thread the strap 108 through to secure the end of the strap 108, and to keep it taut. For instance, the tension on the strap 108 helps to keep the mount assembly 100 secure on the personal or tactical accessory, particularly with an added load of a carrier (such as an implement holster, for example) coupled to the base 102.

As also shown in FIGS. 10 and 11, in an embodiment, the latch plate 106 includes a hinge edge 1002 on at least one edge of the latch plate 106. In the embodiment, the hinge edge 1002 is arranged to fit and engage the catch 804 of the grip plate 104 when locking the latch plate 106 to the grip plate 104. In the embodiment, the hinge edge 1002 and the catch 804 can act as a hinge, engaging each other and allowing the latch plate 106 to pivot with respect to the grip plate 104 at the catch 804, to lock the latch plate 106 to the grip plate 104, tensioning the strap 108, and thus locking the mount assembly 100 to the desired object.

As shown in FIG. 11, in some embodiments, the latch plate 106 includes one or more channels 1102 at one or more portions of the latch plate 106. In the embodiments, a channel 1102 is configured to receive a latch pin 118 (see FIGS. 12 and 13) or the like, to secure the latch plate 106 to the grip plate 104. For instance, the channel(s) 1102 may extend into the latch plate 106 from an outside surface of the latch plate 106, so that when the latch plate 106 is engaged with the recess 802, a latch pin 118 can extend through an opening 806 of the grip plate 104 and into a channel 1102 of the latch plate 106. In this way, the latch plate 106 can be locked to the grip plate 104 until intentionally released. For example, to release the latch plate 106, the latch pin(s) 118 are removed from the opening(s) 806 and the channel(s) 1102, freeing the latch plate 106 to be removed from the grip plate 104. In some embodiments, the channel 1102 comprises a full or partial tube with an elliptical or polygonal cross-section.

Figure 12:
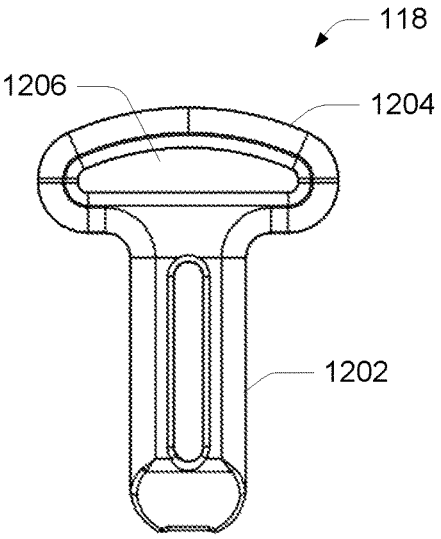
FIGS. 12 and 13 illustrate two views of an example latch pin of the holster mount assembly of FIG. 1, according to an implementation.
Figure 13:
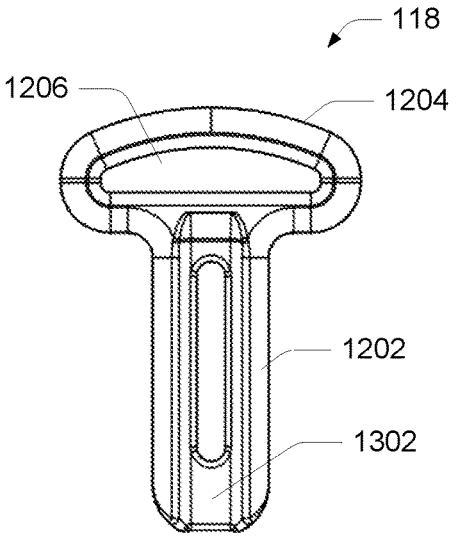

FIGS. 12 and 13 illustrate two views of an example latch pin 118 that may be used with the mount assembly 100, according to an implementation. In various embodiments, the latch pin 118 is arranged to fit within an opening 806 in the grip plate 104 and within a channel 1102 of the latch plate 106 to secure the latch plate 106 to the grip plate 104 when the mount assembly 100 is coupled to a personal or tactical accessory, or the like.

In various embodiments, the shaft 1202 of the pin 118 is shaped to conform to a shape of the opening 806 and/or the channel 1102, for a snug fit. The handle 1204 of the pin 118 may include a slot 1206, for attaching a pull-strap, or the like, for easy removal of the pin 118 from the opening 806 and/or for retaining the pin 118 when it is free from the opening 806. In an alternate embodiment, the pin 118 includes one or more stop features allowing the pin 118 to be removed from the channel 1102, but preventing the pin 118 from being fully removed from the opening 806 of the grip plate 104.

In some embodiments, the pin 118 may include a groove 1302 shaped to conform to a tab 808 on the grip plate 104. The groove 1302 and tab 808 may work together to guide and orient the pin 118 into the opening 806 and the channel 1102. In some embodiments, the tab 808 may engage with a portion of the pin 118 (with the slot 1206, for instance) to prevent the pin 118 from moving within or withdrawing from the opening 806 and the channel 1102 unintentionally. In the embodiments, the user intentionally disengages the tab 808 from the pin 118 to remove the pin 118 from the opening 806 and the channel 1102.

Figure 14:
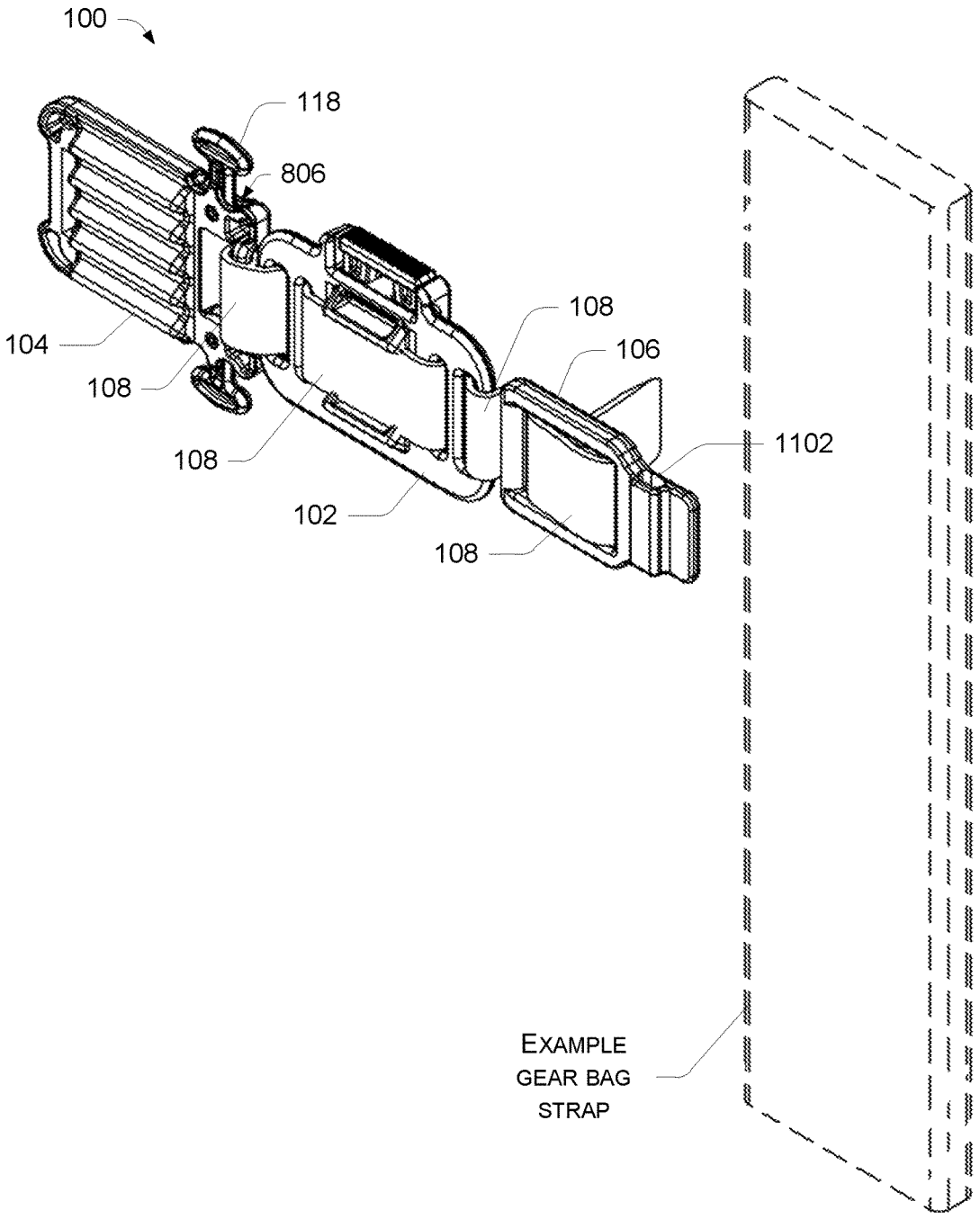
FIG. 14 illustrates a perspective view of the example holster mount assembly of FIG. 1, in an open configuration, according to an implementation.

Referring to FIG. 14, in an embodiment, the base 102, the grip plate 104, and the latch plate 106 are arranged to be coupled together using the strap 108, for example. In an open configuration, as shown in FIG. 14, the mount assembly 100 is ready to be attached to a strap of a gear bag, or the like. As shown, each of the components (the base 102, the grip plate 104, and the latch plate 106) are extended, and can be wrapped around the example gear bag strap in this open configuration.

Figure 17:
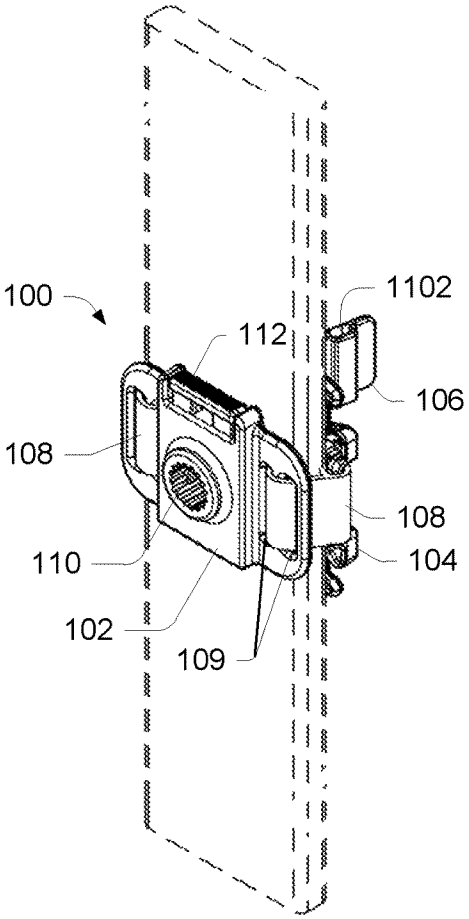
FIGS. 15-20 illustrate an example application of the example holster mount assembly of FIG. 1, including adjusting the example holster mount assembly into a closed configuration, according to an implementation.
Figure 16:
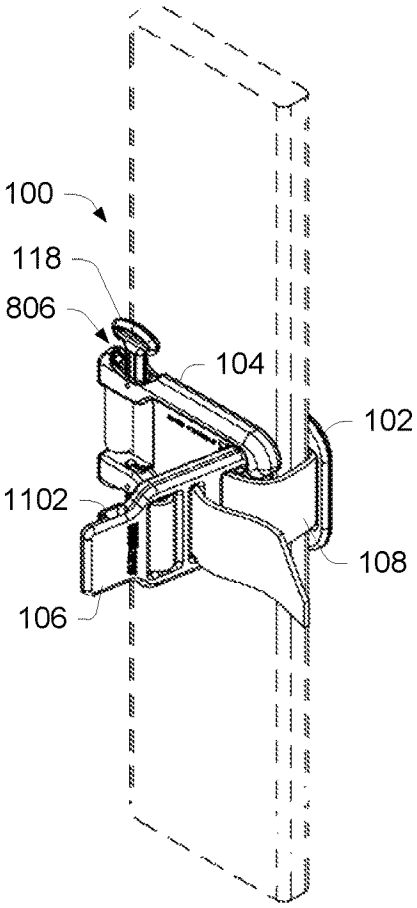
Figure 15:
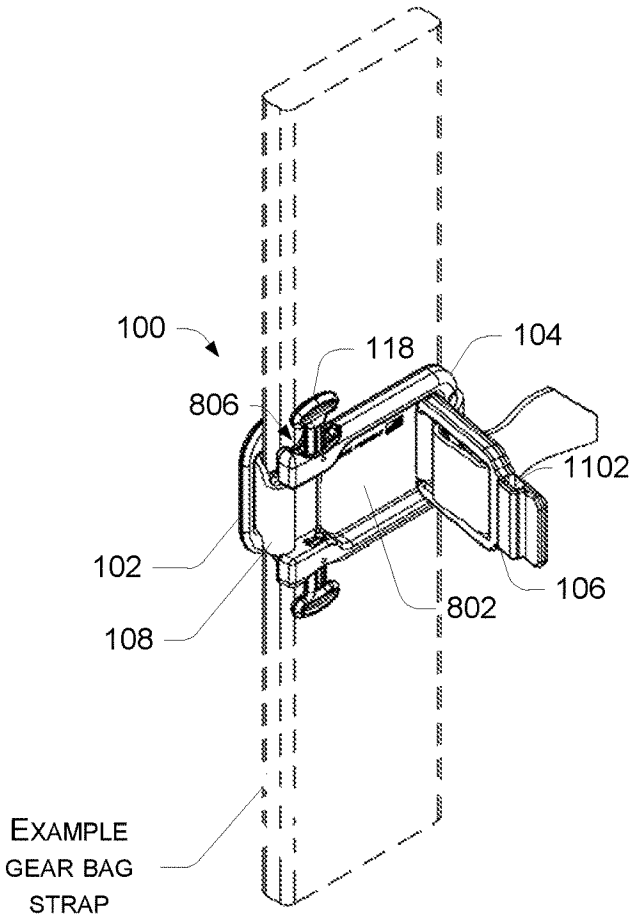

FIGS. 15-20 show various views illustrating an example of mounting the holster mount assembly 100 onto an example gear bag strap, including adjusting the holster mount assembly 100 into a closed configuration around the gear bag strap, according to an implementation. As shown in FIGS. 15-17, the gear bag strap is sandwiched between the base 102 and the grip plate 104. Once the tension of the strap 108 is adjusted as desired for the example gear bag strap, the latch plate 106 can be engaged with the grip plate 106 to lock the mount assembly 100 to the gear bag strap.

The tension of the strap 108 that couples the base 102, the grip plate 104, and the latch plate 106 together determines the tension of the base 102 and the grip plate 104 (or the mount assembly 100) on the gear bag strap. The tension of the strap 108 can be adjusted by pulling more of the strap 108 into the latch plate 106 to tighten or increase tension, and letting out some of the strap 108 from the latch plate 106 to loosen or decrease the tension of the strap 108. Accordingly, the strap 108 can be adjusted as desired for different applications.

The process of adjusting the mount assembly 100 into the closed configuration, as shown in FIGS. 15-17, includes engaging the latch plate 106 at the catch 804 of the grip plate 104, as shown in FIGS. 15 and 16. Note that the latch plate 106 is not yet fully engaged into the recess 802 of the grip plate 106. Further, the latch pins 118 may be sitting in the openings 806, but are not inserted into the channels 1102.

Figure 20:
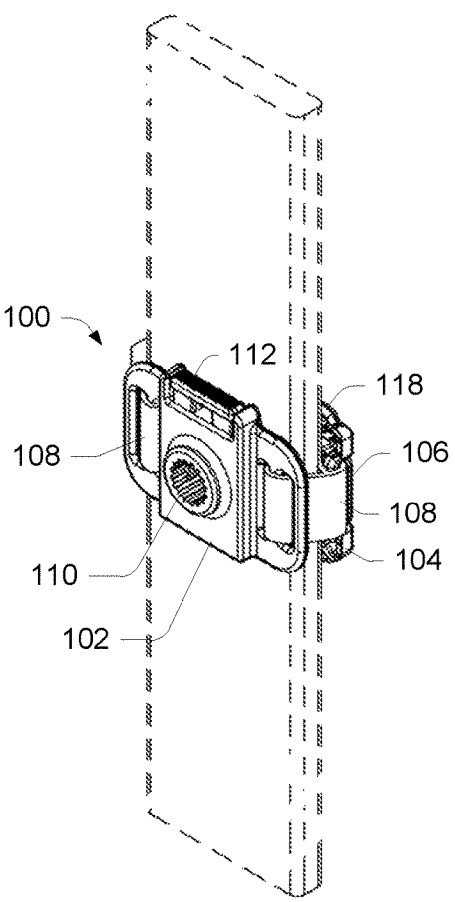
Figure 19:
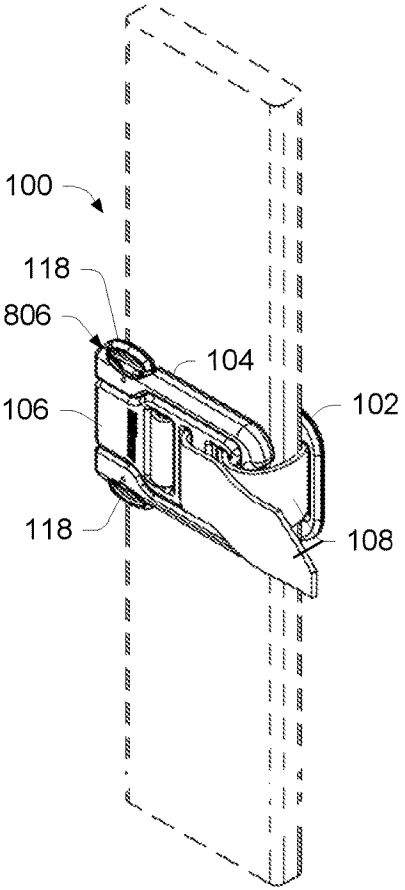
Figure 18:
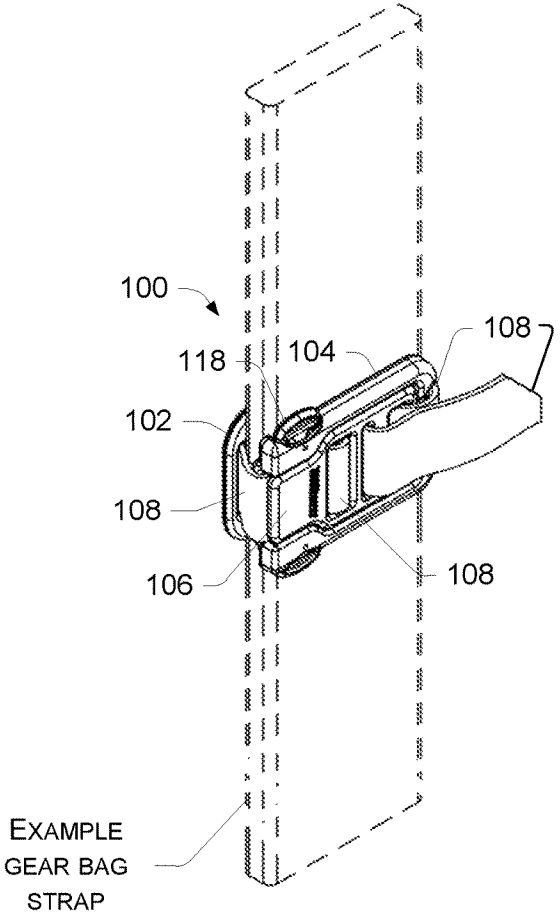

Referring to FIGS. 18-20, once the tension of the strap 108 is pre-adjusted as desired, the latch plate 106 is pivoted at the catch 804 and engages the recess 802 of the grip plate 104. Pivoting the latch plate 106 from the open position to the locked (closed) position at the grip plate 104 tensions the strap 108 to the locked tension, determining the compression of the base 102 and the grip plate 104 on the gear bag strap. With the latch plate 106 in locked position and fully engaged with the grip plate 104, the latch pin(s) 118 are inserted into the channel(s) 1102 (via the openings 806) to lock the latch plate 106.

In the closed configuration illustrated in FIGS. 18-20, the mount assembly 100 has a relatively flat and compact profile that allows for use with various applications. The grip features 402 (on the base 102) and the grip features 902 (on the grip plate 104), which all face toward the gear bag strap, ensure that the mount assembly 100 has a secure hold on the gear bag strap (or the like). The tension on the strap 108 further ensures that the mount assembly 100 remains in place where mounted, until intentionally moved (by opening the mount assembly 100). In alternate implementations, the strap 108 can be supplemented or replaced with hook and loop straps, coupling bands, or other coupling devices or clamps as desired.

The mount assembly 100 can be moved or repositioned on the gear bag strap if needed. Releasing the tension (e.g., pulling the pins 118 and opening the latch plate 106) between the base 102 and the grip plate 104 allows the mount assembly 100 to be slid to a new location on the gear bag strap. The latch plate 106 is closed again, and the pins 118 are inserted into the channels 1102 (from the openings 806) to retighten the mount assembly 100 onto the gear bag strap, securing the mount assembly 100 at the new desired location.

A carrier (such as a handgun holster, for instance) can be attached to the receiver 110 on the base 102 as desired. The button 112 on the base 102 is pressed to release the carrier from the receiver 110 to move the carrier to a new location.

In various implementations, components of the mount assembly 100, including the base 102, the grip plate 104, the latch plate 106, and latch pins 118 are comprised of various plastics, composites, metals, combinations of the same, or the like. For example, the mount assembly 100 components may be comprised of a polyamide, or similar material. In one example, the mount assembly 100 components may be injection molded, stamped, formed, or the like. In various embodiments, the mount assembly 100 components have rigidity and stability properties based on a particular material selected for the mount assembly 100 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the mount assembly 100 components.

The illustrations of FIGS. 1-20 are not intended to be limiting. In the various example embodiments illustrated in FIGS. 1-20, the location and position of the components, mechanisms, and the like, are for example only. Other locations and positions are contemplated and are within the scope of this disclosure. In various implementations, the mount assembly 100 components may have different shapes or sizes than those illustrated, and remain within the scope of the disclosure. In some cases, additional or alternative components, techniques, sequences, or processes may be used to implement the techniques described herein. Further, the components and/or techniques may be arranged and/or combined in various combinations, while resulting in similar or approximately identical results.

It is to be understood that a mount assembly 100 may be implemented as a stand-alone device or as part of another system (e.g., integrated with other components, or the like). In various implementations, additional or alternative components may be used to accomplish the disclosed techniques and arrangements. Although various implementations and examples are discussed herein, further implementations and examples may be possible by combining the features and elements of individual implementations and examples.

In various embodiments, the mount assembly 100 may be added to an existing arrangement (such as holsters and holster mounting apparatus and assemblies, for example). For instance, the existing arrangements may be retrofitted with the mount assembly 100 or with mount assembly 100 components. In other embodiments, the mount assembly 100 may be a part of a new arrangement, such as a new holster rig, case, enclosure, or the like.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A mounting assembly, comprising:

a base, including a substantially planar hard mount component, a receiver on a first surface of the base, one or more grip features on a second surface of the base, and one or more slots through a portion of the base, the base arranged to support an implement or an implement holster;

a grip plate, including one or more grip features on a first surface of the grip plate and one or more slots through a portion of the grip plate, the grip plate adapted to be coupled to the base via at least one of the one or more slots of the grip plate and at least one of the one or more slots of the base, the grip plate and the base arranged to trap a portion of a personal accessory between the first surface of the grip plate and the second surface of the base to removably couple the mounting assembly to the personal accessory; and a latch plate coupled to the base and arranged to engage the grip plate, and to compress the base and the grip plate onto the portion of the personal accessory when pivoted relative to the grip plate.

2. The mounting assembly of claim 1, wherein the latch plate includes one or more slots through a portion of the latch plate, the latch plate adapted to be coupled to the base via at least one of the one or more slots of the latch plate and at least one of the one or more slots of the base.

3. The mounting assembly of claim 2, further comprising one or more straps threaded through at least one of the one or more slots of the base, at least one of the one or more slots of the grip plate, and at least one of the one or more slots of the latch plate, the one or more straps configured to couple the grip plate and the latch plate to the base.

4. The mounting assembly of claim 3, wherein a tension of the one or more straps is arranged to determine a compression of the grip plate and the base on the portion of the personal accessory.

5. The mounting assembly of claim 4, wherein the tension of the one or more straps is determined at least in part by threading the one or more straps through the one or more slots of the latch plate and pivoting the latch plate with respect to the grip plate.

6. The mounting assembly of claim 1, further comprising one or more removable latch pins, and wherein the latch plate includes at least one channel and the grip plate includes at least one opening, the one or more removable latch pins arranged to fit within the at least one channel and the at least one opening to secure the latch plate to the grip plate when the mounting assembly is in a closed configuration.

7. The mounting assembly of claim 1, wherein the latch plate has a perimeter shape arranged to fit within a recess on a second surface of the grip plate when the mounting assembly is in a closed configuration.

8. The mounting assembly of claim 1, wherein the receiver includes a plurality of splines on an inner perimeter of the receiver, arranged to engage another plurality of splines on an outer perimeter of a portion of the implement or the implement holster.

9. The mounting assembly of claim 8, further comprising a lock mechanism arranged to trap the other plurality of splines on the outer perimeter of the portion of the implement or the implement holster from withdrawing from the receiver unintentionally.

10. The mounting assembly of claim 8, wherein the plurality of splines on the inner perimeter of the receiver determine a user-adjustable rotational angle of the implement or the implement holster relative to the base through a quantity of discrete rotational angle increments.

11. The mounting assembly of claim 1, wherein the implement holster comprises a holster for a handgun.

12. A mounting assembly, comprising:

a base, including a substantially planar hard mount component, a receiver on a first surface of the base adapted to receive a portion of an implement holster, one or more grip features on a second surface of the base, and one or more slots through a portion of the base, the base arranged to support an implement and the implement holster;

a grip plate, including one or more grip features on a first surface of the grip plate and one or more slots through a portion of the grip plate, the grip plate adapted to be coupled to the base via at least one of the one or more slots of the grip plate and at least one of the one or more slots of the base, the grip plate and the base arranged to trap a portion of a personal accessory between the first surface of the grip plate and the second surface of the base to removably couple the mounting assembly to the personal accessory; and a latch plate having one or more slots through a portion of the latch plate, the latch plate adapted to be coupled to the base via at least one of the one or more slots of the latch plate and at least one of the one or more slots of the base, the latch plate arranged to engage the grip plate to compress the base and the grip plate onto the portion of the personal accessory.

13. The mounting assembly of claim 12, further comprising a locking mechanism adapted to prevent the portion of the implement holster from exiting the receiver without user intervention when the portion of the implement holster is coupled to the base and the locking mechanism is in a locked position.

14. The mounting assembly of claim 13, wherein the locking mechanism includes a splined portion arranged to align with splines of the receiver when the locking mechanism is in an unlocked position.

15. The mounting assembly of claim 13, wherein the locking mechanism includes one or more catches arranged to protrude into an opening of the receiver and to trap one or more features of the portion of the implement holster when the portion of the implement holster is within the receiver.

16. The mounting assembly of claim 15, further comprising a lock release mechanism adapted to move the one or more catches, releasing the one or more features and allowing the portion of the implement holster to be removed from the receiver when the locking mechanism is in an unlocked position.

17. The mounting assembly of claim 12, wherein the grip plate includes a catch feature and wherein the latch plate is configured to pivotally engage the catch feature of the grip plate to tighten the grip plate and the base onto the portion of the personal accessory.

18. The mounting assembly of claim 12, wherein the grip plate and the latch plate each include one or more complementary features arranged to be engaged to secure the latch plate to the grip plate when the mounting assembly is in a closed configuration.

19. A mounting assembly adapted to be mounted to a textile or flexible surface, comprising:

a base, including a substantially planar hard mount component, a receiver on a first surface of the base adapted to receive a portion of a handgun holster, one or more grip features on a second surface of the base adapted to increase a friction of the second surface of the base, and one or more slots through a portion of the base, the base arranged to support a handgun and the handgun holster;

a grip plate, including one or more grip features on a first surface of the grip plate adapted to increase a friction of the first surface of the grip plate and one or more slots through a portion of the grip plate, the grip plate adapted to be coupled to the base via at least one of the one or more slots of the grip plate and at least one of the one or more slots of the base, the grip plate and the base arranged to trap a strap of a personal accessory between the first surface of the grip plate and the second surface of the base to removably couple the mounting assembly to the personal accessory;

a latch plate having one or more slots through a portion of the latch plate, the latch plate adapted to be coupled to the base via at least one of the one or more slots of the latch plate and at least one of the one or more slots of the base, the latch plate arranged to engage the grip plate to compress the base and the grip plate onto the strap of the personal accessory; and a coupling strap threaded through at least one of the one or more slots of the base, at least one of the one or more slots of the grip plate, and at least one of the one or more slots of the latch plate, the coupling strap configured to couple the grip plate and the latch plate to the base.

20. The mounting assembly of claim 19, further comprising a locking mechanism arranged to move relative to the base and adapted to prevent the portion of the handgun holster from exiting the receiver without user intervention when the portion of the handgun holster is coupled to the base unit and the locking mechanism is in a locked position.

21. The mounting assembly of claim 19, wherein a user-adjustable tension of the coupling strap is arranged to determine a compression of the grip plate and the base on the strap of the personal accessory, the tension of the coupling strap adjusted at least in part by adjusting a threading of the coupling strap through the one or more slots of the latch plate and pivoting the latch plate with respect to the grip plate.

* * * * *